US008876166B2

(12) United States Patent
Brewster et al.

(10) Patent No.: US 8,876,166 B2
(45) Date of Patent: Nov. 4, 2014

(54) SANITIZING LID AND DISPATCH SERVICE THEREOF

(76) Inventors: Peter Hollister Brewster, Hillsborough, CA (US); Michael Simons, Hillsborough, CA (US)

( * ) Notice: Subject to any disclaimer, the term of this patent is extended or adjusted under 35 U.S.C. 154(b) by 301 days.

(21) Appl. No.: 12/916,351

(22) Filed: Oct. 29, 2010

(65) Prior Publication Data

US 2012/0104741 A1 May 3, 2012

(51) Int. Cl.

| | |
|---|---|
| ***B42D 15/00*** | (2006.01) |
| ***B42D 15/10*** | (2006.01) |
| ***A47G 19/22*** | (2006.01) |
| ***B65D 51/20*** | (2006.01) |

(52) U.S. Cl.

CPC ..... *B65D 51/20* (2013.01); *A47G 19/2211* (2013.01); *A47G 2200/08* (2013.01); *A47G 2200/163* (2013.01); *A47G 2200/183* (2013.01); *A47G 2200/143* (2013.01)

USPC ..... 283/56; 283/67; 283/72; 283/81

(58) Field of Classification Search

USPC ..... 283/56, 62, 67, 70, 72, 74, 79, 81

See application file for complete search history.

(56) References Cited

U.S. PATENT DOCUMENTS

| | | | | |
|---|---|---|---|---|
| 2,003,657 | A | 6/1935 | Stubblefield | |
| 5,738,921 | A * | 4/1998 | Andersen et al. | 428/36.4 |
| 5,894,952 | A | 4/1999 | Mendenhall et al. | |
| 5,984,135 | A | 11/1999 | Brown | |
| 6,906,295 | B2 * | 6/2005 | Ge | 219/621 |
| 2005/0178766 | A1 | 8/2005 | Washington | |
| 2007/0178284 | A1 | 8/2007 | Barry | |
| 2008/0190945 | A1 | 8/2008 | Milnark | |
| 2009/0047469 | A1 | 2/2009 | Lane et al. | |
| 2009/0239510 | A1 * | 9/2009 | Sennett et al. | 455/414.1 |
| 2009/0242590 | A1 * | 10/2009 | Saveliev et al. | 222/509 |
| 2010/0163567 | A1 * | 7/2010 | Chiang et al. | 220/703 |
| 2010/0332420 | A1 * | 12/2010 | Groening | 705/500 |
| 2011/0050431 | A1 * | 3/2011 | Hood et al. | 340/603 |
| 2011/0139800 | A1 * | 6/2011 | Urban | 220/713 |
| 2011/0145739 | A1 * | 6/2011 | Berger et al. | 715/763 |

* cited by examiner

*Primary Examiner* — Shelley Self
*Assistant Examiner* — Justin V Lewis
(74) *Attorney, Agent, or Firm* — Squire Patton Boggs (US) LLP

(57) ABSTRACT

An apparatus can include a generally planar portion approximately in a plane. The apparatus can also include a lip portion extending in a direction generally orthogonal to the plane. The generally planar portion is joined to the lip portion at a circumferential edge of the generally planar portion to form a cover for a beverage container. The lip portion includes a sterilizing agent configured to sterilize a rim portion of the beverage container. Likewise, a method can include providing contact information on a disposable cover adapted to cover a beverage container. The contact information is not provided by the manufacturer of the beverage or beverage container. The method can also include receiving contact from a user of the disposable cover. The method can further include coordinating the delivery of a service to the user of the disposable cover responsive to the contact received from the user.

9 Claims, 2 Drawing Sheets

SANITIZING LID AND DISPATCH SERVICE THEREOF

BACKGROUND

1. Field

Lids and covers as well as dispatch of services using lids are discussed. Certain embodiments relating to a sanitizing lid as well as to an ornamental design for a lid are also discussed.

2. Description of the Related Art

Various lids for cups have been made. For example, lids for preventing splashing of a contained fluid are described. These lids have a wide variety of characteristics. For example, some lids are disposable lids that have a depressed area for receiving and containing foodstuff such as condiments. Other lids are more durable lids with a slit and vents or other device that permits a child to drink from the cup, while preventing the cup from spilling if the cup is accidentally overturned. Other lids can adhere to the rim of a container and permit only a straw to access the contents of the beverage container. Still further lids can provide both a spout for drinking and a funnel for adding condiments. Other lids are thin adhesive films that can be applied to the opening of a glass. Still further lids include printing. In short, there are a wide variety of lids.

SUMMARY

In an embodiment of the present invention, an apparatus includes a generally planar portion approximately in a plane. The apparatus also includes a lip portion extending in a direction generally orthogonal to the plane. The generally planar portion is joined to the lip portion at a circumferential edge of the generally planar portion to form a cover for a beverage container. The lip portion comprises a sterilizing agent configured to sterilize a rim portion of the beverage container.

In another embodiment, a method includes forming a generally planar portion approximately in a plane. The method also includes forming a lip portion extending in a direction generally orthogonal to the plane, wherein the generally planar portion is joined to the lip portion at a circumferential edge of the generally planar portion to form a cover for a beverage container. The method additionally includes providing a sterilizing agent configured to sterilize a rim portion of the beverage container, wherein the sterilizing agent is provided in the lip portion.

In a further embodiment, a method includes providing contact information on a disposable cover adapted to cover a beverage container, wherein the contact information is not provided by the manufacturer of the beverage or beverage container. The method also includes receiving contact from a user of the disposable cover. The method further includes coordinating the delivery of a service to the user of the disposable cover responsive to the contact received from the user.

In another embodiment, a cover has the ornamental design substantially as shown in the accompanying drawings, and/or as described in the detailed written description herein.

BRIEF DESCRIPTION OF THE DRAWINGS

For proper understanding of the invention, reference should be made to the accompanying drawings, wherein.

DETAILED DESCRIPTION OF THE PREFERRED EMBODIMENT(S)

Figure 1:
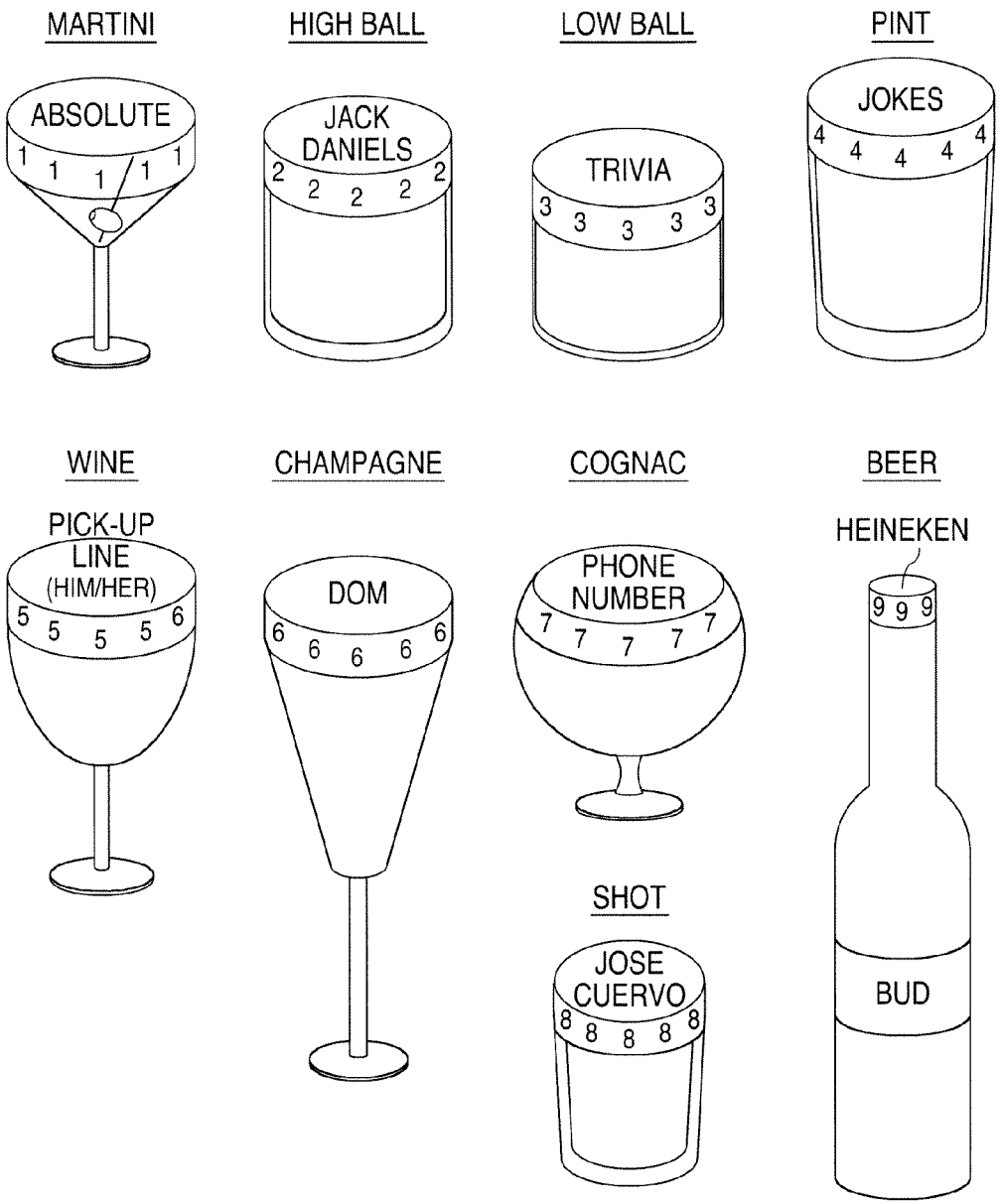
FIG. 1 illustrates various covers according to embodiments of the present invention.

In a restaurant environment, cups can come in a variety of shapes and sizes. Generally, however, in a particular restaurant, cups will all have two common features. Cups will normally appear to be similar to other cups in the restaurant, and cups will have an open top surface, also called the mouth of the cup. In certain instances, users of cups drink from the cup by a straw or similar mechanism. However, in other instances users drink from a cup by placing the cup against their lower lip and tilting the cup to pour the cup's contents into the respective user's mouth.

Cups may also have other features, including sides, a bottom, and optionally one or more handle. Other features, such as a built-in straw, may optionally appear and should not be considered to have been excluded.

The mouth of the cup is normally defined by a rim. Most cups feature circular rims, although other shapes of rims, such as oval, octagonal, hexagonal, or even square are sometimes used. In the examples below, typically a cup with a circular mouth is assumed, but any shape is permitted. Oftentimes, the term "rim" encompasses also a portion of the side of the cup, where the user's lip touches the cup in the ordinary course of drinking from the cup.

A cover can be fitted to the rim and can extend over the mouth of the cup. The cover may be formed in different shapes. However, a cover may have a generally planar section, and optionally a downwardly directed lip portion. The generally planar section can be configured to be concave, convex, domed, or patterned. The patterning can take various forms, such as a bas-relief image or text. High relief and sunken relief images and text are also possible. The lip may similarly be variously decorated. The cover can be decorated with color and/or text.

In many cups, the circumference of the mouth of the cup is larger than the circumference of the base of the cup. In this situation, for example, the cover can be configured to serve two purposes. In a first purpose, the cover is configured to cover the mouth of the cup. In the second purpose, the cover is configured to serve as a coaster for the base of the cup. Although such a cover can serve two purposes, for consistency of explanation, the "top" of the cover is a reference herein to the top surface of the cover when it is being used to cover the mouth of a cup, whereas the "bottom" of the cover is a reference herein to the surface of the cover that is facing up when the cover is in a coaster configuration, that is, the opposite side from the top.

Not all covers may be configured for this dual purpose. For example, some covers may be configured only to serve as covers and not as coasters. In examples where a cover is configured to serve as a coaster, the top of the cover may be patterned with bumps or provided with a high-friction non-slip surface to control the behavior of the cover with respect to a substrate, such as a table or bar, on which on the cover is resting when in coaster configuration.

The cover can, in certain instances, be a reversible cover. Thus, the cover may have two sides, each of which can be the "top" depending on how the cover is positioned. Additionally, a lip of the cover, if provided, may be configured to be able to be reversed so that it extends in an opposite direction. To permit such reversal, the lip may be formed of a flexible, resilient material, such as rubber.

In another embodiment, the cover can originally be manufactured in a flattened configuration, with the lip extending circumferentially. In such an embodiment, a thin layer of metal can be embedded within the lip and optionally within a portion of the generally planar section. This metal may permit the lip to be bent into a particular shape and then to maintain that shape.

The cover can be a removable cover or a permanent cover. In the case of a removable cover, the cover can be either secured or unsecured. An example of an unsecured cover is a cover that generally rests on the mouth of the cup and is held in place by gravity.

A secured cover may interface with the rim or some other portion of the cup. For example, the cover can interface with a portion of a handle or other protrusion of the cup. Alternatively, the cover may interface with a portion of the side of the cup slightly below the rim. However, in general this area may be referred to as the rim in a broad sense.

There are various ways that the cover can interface with the rim. For example, the cover can form a simple interference fit by simply being tightly fitted to the outside surface of the rim. Alternatively, the cover can incorporate a clipping mechanism to enhance the simple interference fit.

Additionally, it is possible for the cover to be screwed onto the rim. This may require that the rim be threaded, either in whole or in part. Other kinds of fits are also possible. For example, the rim may include a protrusion in a circumferential direction, and the cover may be configured to snap over the protrusion.

Furthermore, the cover may include a contact adhesive or some other chemical adhesive agent that permits the cover to bond to the rim, or a portion of the rim, of the cup. This adhesive may be a non-permanent low tack adhesive.

Instead of, or in addition to, the low tack adhesive, an inside surface the lip of the cover may be provided with a sterilizing agent. The sterilizing agent may be a weak sterilizing agent, such as lemon juice or similar weak acid solution, or the sterilizing agent may be a stronger sterilizing agent such as high concentration alcohol. Other sterilizing agents, such as a silver solution, are also permitted.

Another alternative for sterilization is to provide ultraviolet light through the interior surface of the lip of the cover. The ultraviolet light could be generated in the generally planar section and then transmitted by a light guide, such as optical fibers or mirrors, to the edge.

In cases where the cover is to be removed and normally drinking to be performed on the cup, the sterilizing agent may be selected to be a sterilizing agent that is not poisonous. An example of a poisonous sterilizing agent would be bleach.

The generally planar section and/or the lip portion of the cover may be formed of a single material, such as molded resin, or it may be formed from a composite of materials in various layers. For example, a decorative layer may be formed on the top surface of the cover, whereas a water-resistant layer may be formed on a bottom surface of the cover. The water-resistant layer may be a wax layer.

The cover may include an insert. The insert may be removably inserted into a pocket or the insert may be permanently embedded or laminated into the cover. The insert may be decorative or informative. For example, the insert may provide advertising information or instructions.

Alternatively, the insert may have a functional purpose. For example, the insert may be designed to heat or cool the rim of the cup. Thus, for example, the insert may be a chemical insert configured to perform an exothermic or endothermic reaction to either heat or cool the rim of the cup. In such a situation, the inside lip of the cup may be formed of a material with good thermal conductivity, such as a metal.

In certain embodiments, the cover may be equipped with an electronic display. The electronic display may be operated by battery power, by a photodiode, or other power supply means. The electronic display may be always on, or may be triggered by pressure or acceleration sensors in the cover.

Thus, for example, the cover may configured to display a message when the cover is placed onto a cup, but the cover may be configured to be off when not placed on a cup. Thus, battery life of the cover may be conserved.

For determining a duration of time that the cover is in use, the cover may be equipped with a timer. The timer may also be connected to the display to show an indication of how long the cover has been used, or the time of day, or the time until a restaurant or bar associated with the cover closes or stops serving alcoholic drinks.

The cover can be configured to have an interactive display. Thus, the cover may further include a user interface. The user interface may include one or more button or toggle, or alternatively may include a touch-sensitive surface. The cover may also be configured to interact with the user through the use of one or more accelerometer.

The cover can also be equipped with a temperature-sensing device. This device can be a temperature-sensitive pigment that changes colors depending on the temperature of the environment, or the device can be a thermometer. The cover can be configured to display temperature information regarding the cup or its contents to the user.

The cover can be equipped with a speaker or similar audio device. The speaker can be configured to inform the user of various information or the speaker can serve as an alarm. For example, the speaker can be configured together with an accelerometer or pressure sensor to provide an audible alert when the cover is lifted from the cup. Additionally, the alert can include a warning such as, "be careful, your drink is still hot," so as to alert the user that the drink may not yet be at a maximally safe temperature.

The cover can also be equipped with a communication device that permits the cover to communicate with another device. For example, the cover may be able to communicate with the device of a bar-tender to indicate on the cover of the device or by use of audio means a current amount of a bar tab or a number of drinks served to the user of the cover. The cover may also be configured to provide an audio or visual alert to the user of the cover, or to the bartender, when a predetermined condition (such as a service limit on drinks or a spending limit set by the user) has been met.

In further embodiments, advertisements may be displayed on the cover of the cup, either statically or dynamically. A static advertisement may be achieved by, for example, placing an advertising insert in a pocket of the cover, embedding the advertising in molded resin, or laminating the advertising onto the top surface of the cover.

A dynamic advertisement may be an advertisement that is configured based on a number of drinks consumed, duration of time that the cover is in use, or the like. Thus, for example, the dynamic advertisement may initially invite the user to order additional drinks, but subsequently may advertise the services of a taxicab company or the like. Additionally, the cover may be configured to take into account the time of day, and suggest the purchase of traditional morning drinks, such as coffee or orange juice in the morning, soft drinks and iced tea around lunch time, and wine, beer, cocktails, and other alcoholic drinks in the evening.

Additionally, the cover may be configured to display the user's name in a prominent way, so that multiple covered cups can be easily distinguished from one another. This can be accomplished by the use of an interactive programmable display on the cover, and the name may be entered by the user of the cover or by a bartender operating a remote display control device. The name may alternatively be displayed by having the name written on a top surface of the cover.

For having the name written on the top surface of the cover, the top surface can be configured to have an erasable rewritable surface, like a chalkboard or a dry-erase board. Alternatively, the cover can have a paper layer as a top layer of the cover, and the writing can be performed on this paper layer. This approach may be suitable when the cover is a disposable cover.

In a further alternative, the cover may be adapted to permit the application of either a permanent or removable label. Then, a label with the user's name may be adhered to the top surface of the cover.

Similarly, the advertising can be accomplished by providing a label on the top surface of the cover. For example, in a restaurant environment, the label can indicate a special of the day or a daily menu.

The cover can also be used for communication from the user to restaurant staff or a bartender. For example, the user can write on the top surface of the cover. Alternatively, in the case of a reversible cover, one side of the cover can indicate that continued service is desired with a message such as, "Keep the drinks coming," and the opposite site of the cover can indicate that the user is finished, with a message such as, "Check please!"

The cover can also be integrated into a dispatching system. For example, a dispatching system can include at least a call receiving center and a dispatch center, which may be the same center. The call receiving center can be configured to receive calls from customers who have received an advertising message from a cover according to certain embodiments of the present invention.

The dispatching center may then dispatch a service provider to attend to the needs of the customer. For example, the service to be provided may be a taxicab service. Alternatively, other services, such as a bail bondsman services, escort services, or security services may be the services to be provided.

The dispatching center may contact a local cabbie directly or may contact the dispatcher of a local taxicab company and coordinate pickup of the customer with the local taxicab company. Alternatively, the dispatching center may transfer a call from the user of the cover to the dispatcher of a local taxicab company.

In another embodiment, the user sends an email, short message service (SMS) message, or text message to the dispatching center, and the dispatching center provides the phone number for a local taxicab company, or provides the number of the user to a local taxicab company.

In specific embodiments, a cover or lid can be designed for specific or standard-sized cocktail, wine, martini, low-ball, high-ball, margarita, beer stein, pint, champagne, cognac, port, shot, hurricane, Armagnac, dessert wines, grappa, and scotch glasses, and the like, including also glasses that are for consumption of non-alcoholic beverages.

Additionally, a separate and specific lid design can be used for a beer bottle or the bottle of a non-alcoholic bottled drink, such as root beer. The lids can be designed to cover the glass or bottle when the owner of the glass or battle is absent, distracted, or concerned about the security of their drinking vessel.

The design of the lid, according to a particular embodiment, can include a numbering system and can be color-coded to allow the owner's drinking vessel to be identified. The numbering system may be, for example, covers each having a single number from 1 to 1000. The color coding scheme may be blue for men and pink for women. Additionally, the lid can designate that a location is occupied, and can allow service providers, such as waiters and bartenders, to locate a corresponding patron.

The lids can be designed with specific logos, jokes, trivia, wedding details, upcoming events, pick-up lines, local taxicab numbers, a responsible drinking designation, or any combination of those. The logos can include locals of hotel chains, beverage manufactures, restaurants, casinos, sports teams, or the like.

The lid can be made from a green-based or recyclable material, such as recycled paper or corn. The design may include a natural antiseptic inner coating, such as a coating derived from a lemon. This may help to protect the lip area of the vessel from germs and may promote overall hygiene.

FIG. 1 illustrates several embodiments of the present invention. As shown in FIG. 1, covers can be designed for a variety of glasses and bottles. A martini glass cover may be equipped with a via that permits a straw, toothpick, or stirrer to remain in the glass despite the presence of the cover. As shown, the lip of the cover may be provided with multiple representations of a unique number, in this instance the number is 1. Additionally, the manufacturer of a vodka may be advertised on the top surface of the cover.

The cover of a high ball glass may be similarly constructed, although there may be no requirement for a via for a straw or the like to pass through the cover. The cover may be colored, and the manufacturer of a whisky may be advertised on the top surface of the cover. The number 2 is provided repeatedly around the lip of the low ball glass.

The cover of a low ball glass is also illustrated. In this instance, the cover of the glass displays trivia. The trivia may, for example, be a geographic question, such as "What is the tallest mountain in the U.S.?" The reverse side of the cover may have the answer printed, or the answer may be printed upside down in a much smaller font on the cover. This cover has the number 3 repeatedly printed on the lip of the cover.

A pint glass cover, as illustrated, may include a joke written on the top surface of the cover. The number 4 is shown as repeatedly printed on the lip of the cover.

A wine glass cover is shown with the number 5 repeatedly printed on the cover. On the top surface of the wine glass cover, a pick-up line has been printed. The pick-up line can be customized to be a pick-up line for picking up a particular sex, either male or female. The cover can also be colored so as to make easy identification of an appropriate pick-up line easier. For example, pink covers may indicate pick-up lines to be used by women, and blue covers may indicate pick-up lines to be used by men. The lip of the cover may be decorated with the number 5.

A Champaign glass cover may have the number 6 on its lip. The top surface of the cover may advertise a premium Champaign.

A cognac glass cover may have the number 7 printed on its lip. The top surface of the cover may have a phone number printed. This phone number may be the phone number of a local taxicab company or a nationwide taxicab dispatch center. Other phone numbers, such as the phone number of the restaurant that is providing the covers, are also possible.

A shot glass may have the number 8 printed on its lip. The top surface of the cover may advertise a tequila manufacturer. Likewise, a beer bottle cover may advertise the manufacturer of a beer. The beer bottle cover shown may have the number 9 on its lip.

In the examples above, there is no requirement that the manufacturer of the beverages advertised corresponds to the actual beverage in the container. However, the advertisement may be tailored according to the kind of beverage. For example, an imported beer manufacturer may be advertised, even if the cover is going on a domestic bottle of beer.

The numbered lips have been shown with a variety of numbers, and a different number for each kind of beverage holder. However, there is no requirement that numbers be assigned in this manner. Thus, for example, shot glass covers may come in a variety of different numbers, from 1 to 100, and not only the number 8.

Figure 2:
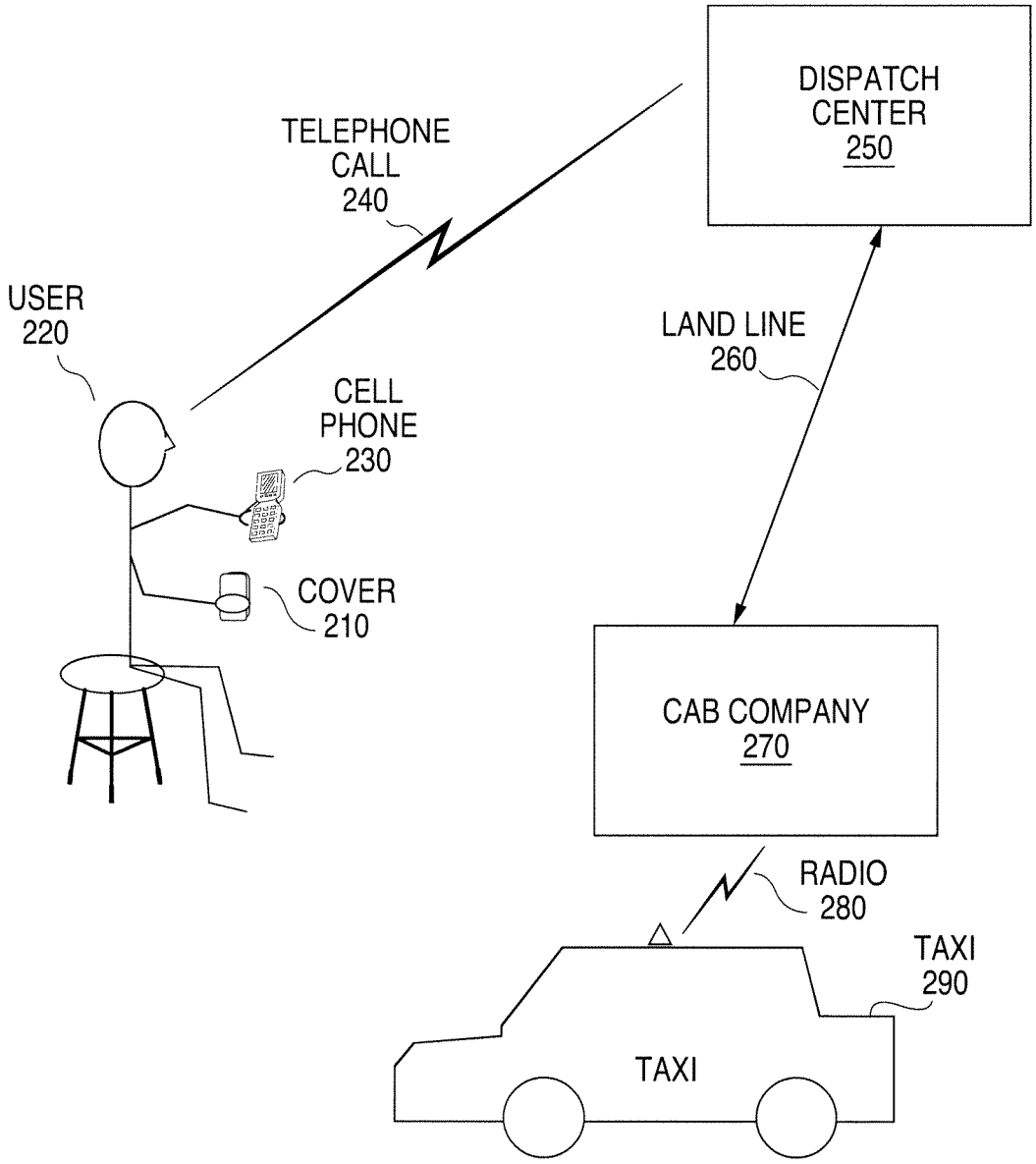
FIG. 2 illustrates a system according to certain embodiments of the present invention.

FIG. 2 illustrates a system according to certain embodiments of the present invention. As shown in FIG. 2, a cover 210 may advertise the phone number of a central dispatch for taxis. The user 220 may employ a cell phone 230 to make a telephone call 240 to the dispatch center. The dispatch center 250 may obtain the geographic information of the user 220 and determine the location of the user 220, as well as the urgency of the need for transportation by the user 220.

The user 220 may be one or more people. The user 220 need not make the call personally: someone could call on behalf of the user. Instead of cell phone 230, another communication device, such as a text messaging device, an emailing device, or a conventional land-line phone can be used. The dispatch center 250 can obtain the geographic information by requesting it from the user 220 or person calling on behalf of the user. Alternatively, the dispatch center 250 could use caller ID or a geographic tag provided by the communication device of the user 220 to determine a location.

The dispatch center 250 may then use a land line 260 to call a local cab company 270 and determine the availability of transportation, or forward the user 220 to the local cab company 270. The local cab company 270 may then radio 280 to a taxi 290 of a fleet of taxis (not shown) and direct the taxi 290 to pick up the user 220.

Instead of using a land line 260, the dispatch center 250, could contact the local cab company 270 according to other communication methods. For example, the dispatch center 250 could call using a Voice over Internet Protocol (VoIP) phone or could use a text messaging or e-mail system. Likewise, the local cab company 270 could contact the taxi 290 by the use of a mobile phone or pager, rather than by use of radio 280.

In certain embodiments, the user 220 may then present the cover 210 to the drive of the taxi 290 to serve as a voucher or coupon for payment or subsidy of a ride home.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

What is claimed is:

1. An apparatus, comprising: i) a planar portion in a plane; ii) a lip portion extending in a direction orthogonal to the plane, wherein the planar portion is joined to the lip portion at a circumferential edge of the planar portion to form a cover for a beverage container; iii) an accelerometer; iv) a speaker; v) an electronic display; vi) a timer; vii) a touch-sensitive user interface provided on the planar portion; viii) a removable insert in a pocket of the planar portion; ix) communication equipment configured to communicate between the apparatus and another device; x) a power supply; and xi) an alarm configured to provide an audible alert with the speaker based on data obtained from the accelerometer indicating when the apparatus is lifted from the beverage container, wherein the electronic display is configured to display at least one of how long the apparatus has been in use or a time until service ends at a restaurant or bar based on data obtained from the timer, wherein the apparatus is configured to be reversible with respect to a horizontal plane, so that a top surface may become an underside, wherein the apparatus is configured as an unsecured cover, wherein the communication equipment is configured to permit remote control of the electronic display by a remote control device, and wherein at least one of the top surface or the underside is configured to provide a high-friction non-slip surface when positioned in a coaster configuration.

2. The apparatus of claim 1, wherein the apparatus is provided with a water-resistant layer.

3. The apparatus of claim 1, wherein the user interface is configured to provide a dynamic advertisement to a user, wherein content of the dynamic advertisement is configured to vary in dependence on the timer.

4. The apparatus of claim 1, wherein the circumference of the planar portion is configured to correspond to a rim of a glass.

5. The apparatus of claim 1, wherein the power supply comprises at least one of a battery or a photodiode.

6. The apparatus of claim 1, wherein the planar portion is provided with a via that is configured to permit an object in the beverage container to pass through the cover.

7. The apparatus of claim 3, wherein the dynamic advertisement is configured initially to invite a user to order additional drinks and subsequently to advertise a taxicab company.

8. The apparatus of claim 1, further comprising: a thermometer, wherein the electronic display is connected to the power supply and is configured to communicate a temperature determined by the thermometer to a user of the apparatus at the planar portion.

9. The apparatus of claim 1, wherein the lip portion comprises a sterilizing agent configured to sterilize a rim portion of the beverage container, and wherein the sterilizing agent comprises ultraviolet light provided over optical fibers in the lip portion.

* * * * *